US006890067B2

(12) United States Patent
Hock et al.

(10) Patent No.: US 6,890,067 B2
(45) Date of Patent: May 10, 2005

(54) FLUID EJECTION ASSEMBLY

(75) Inventors: Scott Hock, Poway, CA (US); Hector Lebron, San Diego, CA (US); Paul Crivelli, San Diego, CA (US); Kenneth Diest, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 12 days.

(21) Appl. No.: 10/613,471

(22) Filed: Jul. 3, 2003

(65) Prior Publication Data

US 2005/0001886 A1 Jan. 6, 2005

(51) Int. Cl.[7] ..... B41J 2/45
(52) U.S. Cl. ..... 347/71; 347/40
(58) Field of Search ..... 347/12, 13, 40, 347/48, 62, 65, 71

(56) References Cited

U.S. PATENT DOCUMENTS

| | | | | |
|---|---|---|---|---|
| 4,412,224 A | | 10/1983 | Sugitani | |
| 4,438,191 A | | 3/1984 | Cloutier et al. | |
| 4,455,560 A | * | 6/1984 | Louzil | 347/71 |
| 4,567,493 A | | 1/1986 | Ikeda et al. | |
| 4,596,994 A | | 6/1986 | Matsuda et al. | |
| 4,611,219 A | | 9/1986 | Sugitani et al. | |
| 4,646,110 A | | 2/1987 | Ikeda et al. | |
| 4,680,595 A | | 7/1987 | Cruz-Uribe et al. | |
| 4,695,854 A | | 9/1987 | Cruz-Uribe | |
| 4,730,197 A | | 3/1988 | Raman et al. | |
| 4,777,494 A | | 10/1988 | Shibata et al. | |
| 4,823,149 A | * | 4/1989 | Martner et al. | 347/71 |
| 4,894,664 A | | 1/1990 | Tsung Pan | |
| 4,897,668 A | | 1/1990 | Nagato et al. | |
| 4,905,017 A | | 2/1990 | Sugitani et al. | |
| 4,929,964 A | | 5/1990 | Sato et al. | |
| 4,965,594 A | | 10/1990 | Komuro | |
| 5,068,674 A | | 11/1991 | Sato et al. | |
| 5,132,707 A | | 7/1992 | O'Neill | |
| 5,163,177 A | | 11/1992 | Komura | |
| 5,165,061 A | | 11/1992 | Witteveen | |
| 5,469,199 A | | 11/1995 | Allen et al. | |
| 5,565,900 A | | 10/1996 | Cowger et al. | |
| 5,592,203 A | | 1/1997 | Thiel et al. | |
| 5,604,519 A | * | 2/1997 | Keefe et al. | 347/13 |
| 5,610,641 A | * | 3/1997 | Ikado | 347/33 |
| 5,748,214 A | | 5/1998 | Usui et al. | |
| 5,752,303 A | | 5/1998 | Thiel | |
| 5,802,687 A | | 9/1998 | Thiel et al. | |
| 5,825,382 A | | 10/1998 | Thiel | |
| 5,880,756 A | | 3/1999 | Ishii et al. | |
| 5,883,651 A | | 3/1999 | Thiel et al. | |
| 5,956,059 A | | 9/1999 | Usui | |
| 5,969,736 A | * | 10/1999 | Field et al. | 347/85 |
| 6,024,440 A | * | 2/2000 | Murthy et al. | 347/65 |
| 6,044,646 A | | 4/2000 | Silverbrook | |
| 6,135,586 A | | 10/2000 | McClelland et al. | |
| 6,155,674 A | | 12/2000 | Figueredo et al. | |
| 6,206,501 B1 | | 3/2001 | Ishii et al. | |
| 6,209,991 B1 | | 4/2001 | Regan et al. | |
| 6,281,912 B1 | | 8/2001 | Silverbrook | |
| 6,286,939 B1 | | 9/2001 | Hindman et al. | |
| 6,328,428 B1 | | 12/2001 | Keefe et al. | |
| 6,367,911 B1 | | 4/2002 | Windel et al. | |
| 6,378,991 B1 | | 4/2002 | Lim et al. | |
| 6,409,323 B1 | | 6/2002 | Silverbrook | |
| 6,457,796 B1 | | 10/2002 | Fujii | |
| 6,471,339 B1 | | 10/2002 | Kamiyama et al. | |

FOREIGN PATENT DOCUMENTS

| | | |
|---|---|---|
| EP | 0087653 | 12/1982 |
| EP | 1125745 | 8/2001 |
| WO | PCT/US2004/020677 | 6/2004 |

* cited by examiner

*Primary Examiner*—Anh T. N. Vo

(57) ABSTRACT

A fluid ejection assembly includes at least one inner layer having a fluid passage defined therein, and first and second outer layers positioned on opposite sides of the at least one inner layer. The first and second outer layers each have a side adjacent the at least one inner layer and include drop ejecting elements formed on the side and fluid pathways communicated with the drop ejecting elements. The fluid pathways of the first and second outer layers communicate with the fluid passage of the at least one inner layer, and the at least one inner layer and the fluid pathways of the first outer layer form a first row of nozzles, and the at least one inner layer and the fluid pathways of the second outer layer form a second row of nozzles.

55 Claims, 6 Drawing Sheets

FLUID EJECTION ASSEMBLY

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

One way to increase printing speed of an inkjet printing system is to increase the number of nozzles in the system and, therefore, an overall number of ink drops which can be ejected per second. In one arrangement, commonly referred to as a wide-array inkjet printing system, the number of nozzles is increased by mounting a plurality of individual printheads or printhead dies on a common carrier. Unfortunately, mounting a plurality of individual printheads dies on a common carrier increases manufacturing complexity. In addition, misalignment between the printhead dies can adversely affect print quality of the inkjet printing system.

For these and other reasons, there is a need for the present invention.

SUMMARY

One aspect of the present invention provides a fluid ejection assembly. The fluid ejection assembly includes at least one inner layer having a fluid passage defined therein, and first and second outer layers positioned on opposite sides of the at least one inner layer. The first and second outer layers each have a side adjacent the at least one inner layer and include drop ejecting elements formed on the side and fluid pathways communicated with the drop ejecting elements. The fluid pathways of the first and second outer layers communicate with the fluid passage of the at least one inner layer, and the at least one inner layer and the fluid pathways of the first outer layer form a first row of nozzles, and the at least one inner layer and the fluid pathways of the second outer layer form a second row of nozzles.

DETAILED DESCRIPTION

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
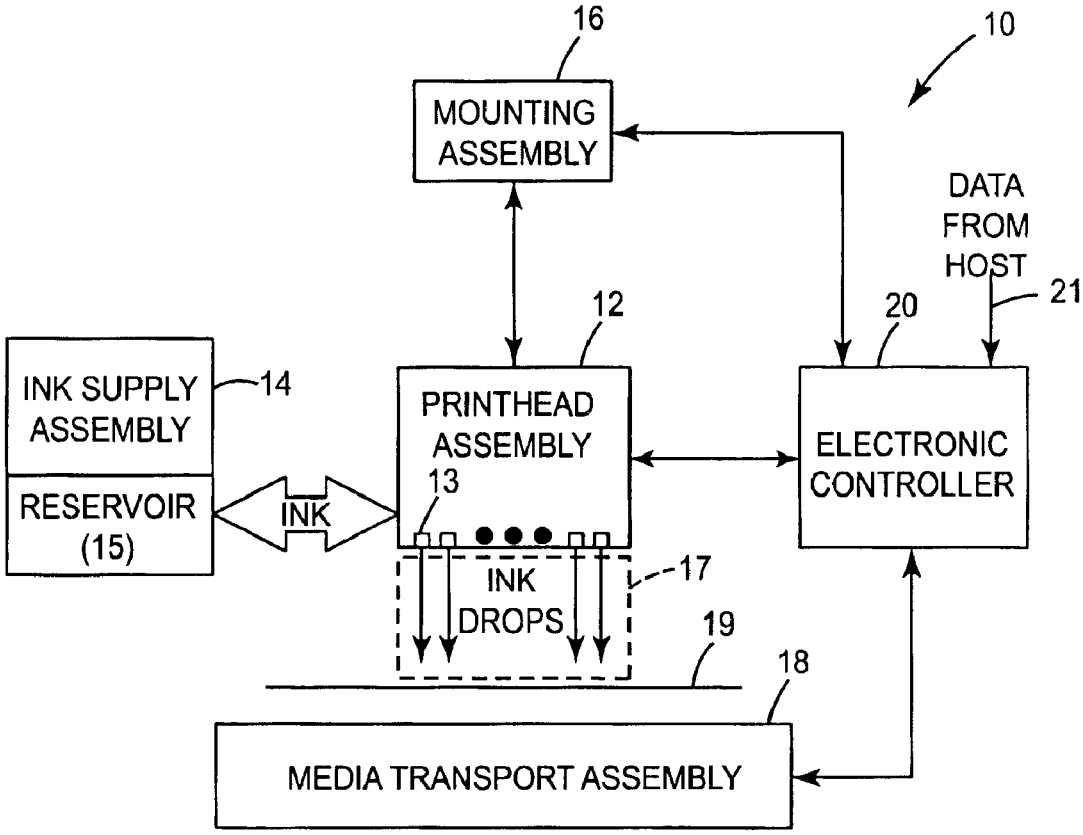
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection assembly, such as a printhead assembly 12, and a fluid supply assembly, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection assembly, is formed according to an embodiment of the present invention and ejects drops of ink, including one or more colored inks or UV readable inks, through a plurality of orifices or nozzles 13. While the following description refers to the ejection of ink from printhead assembly 12, it is understood that other liquids, fluids, or flowable materials, including clear fluid, may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes any type of suitable sheet material, such as paper, card stock, envelopes, labels, transparencies, Mylar, and the like. In one embodiment, print media 19 is a continuous form or continuous web print media 19. As such, print media 19 may include a continuous roll of unprinted paper.

Ink supply assembly 14, as one embodiment of a fluid supply assembly, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly 12 through an interface connection, such as a supply tube.

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. Print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry is located off printhead assembly 12.

Figure 2:
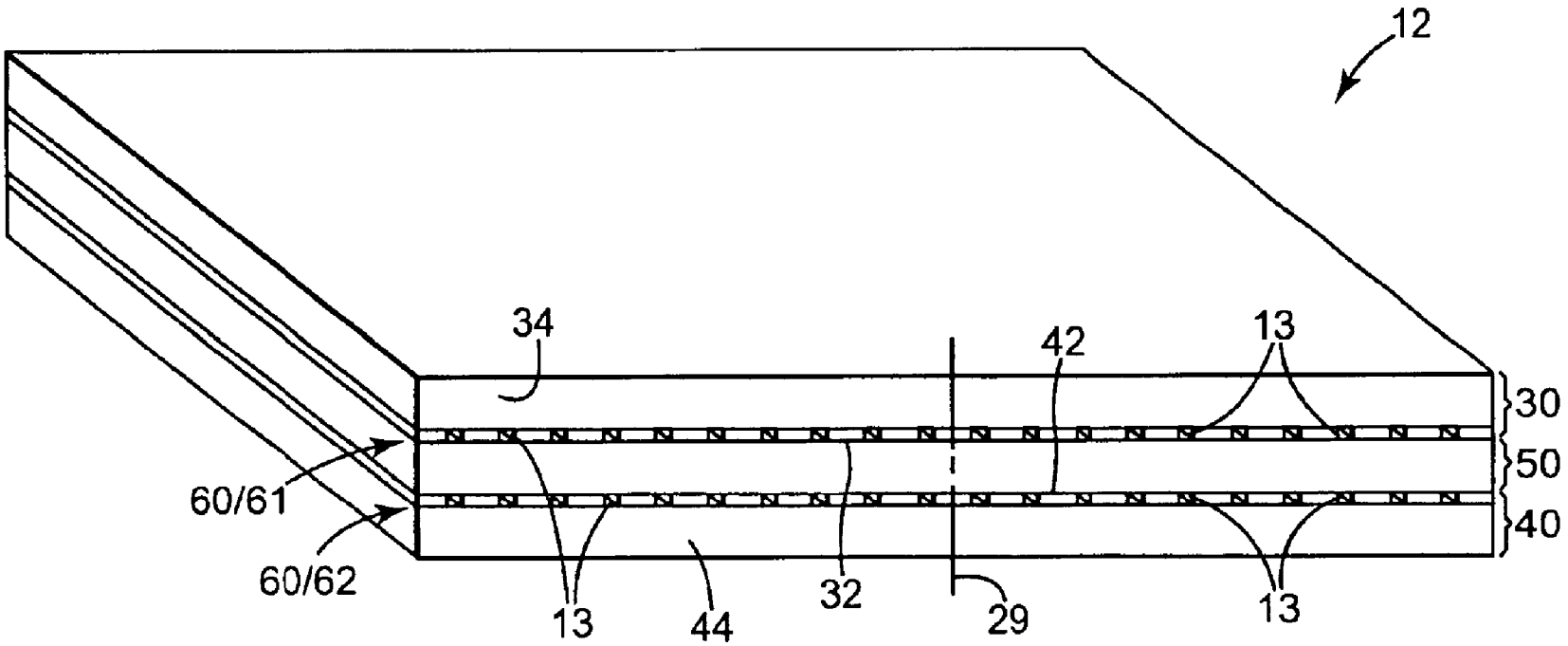
FIG. 2 is a schematic perspective view illustrating one embodiment of a printhead assembly according to the present invention.

FIG. 2 illustrates one embodiment of a portion of printhead assembly 12. In one embodiment, printhead assembly 12 is a multi-layered assembly and includes outer layers 30 and 40, and at least one inner layer 50. Outer layers 30 and 40 have a face or side 32 and 42, respectively, and an edge 34 and 44, respectively, contiguous with the respective side 32 and 42. Outer layers 30 and 40 are positioned on opposite sides of inner layer 50 such that sides 32 and 42 face inner layer 50 and are adjacent inner layer 50. As such, inner layer 50 and outer layers 30 and 40 are stacked along an axis 29.

As illustrated in the embodiment of FIG. 2, inner layer 50 and outer layers 30 and 40 are arranged to form one or more rows 60 of nozzles 13. Rows 60 of nozzles 13 extend, for example, in a direction substantially perpendicular to axis 29. As such, in one embodiment, axis 29 represents a print axis or axis of relative movement between printhead assembly 12 and print media 19. Thus, a length of rows 60 of nozzles 13 establishes a swath height of a swath printed on print media 19 by printhead assembly 12. In one exemplary embodiment, rows 60 of nozzles 13 span a distance less than approximately two inches. In another exemplary embodiment, rows 60 of nozzles 13 span a distance greater than approximately two inches.

In one exemplary embodiment, inner layer 50 and outer layers 30 and 40 form two rows 61 and 62 of nozzles 13. More specifically, inner layer 50 and outer layer 30 form row 61 of nozzles 13 along edge 34 of outer layer 30, and inner layer 50 and outer layer 40 form row 62 of nozzles 13 along edge 44 of outer layer 40. As such, in one embodiment, rows 61 and 62 of nozzles 13 are spaced from and oriented substantially parallel to each other.

In one embodiment, as illustrated in FIG. 2, nozzles 13 of rows 61 and 62 are substantially aligned. More specifically, each nozzle 13 of row 61 is substantially aligned with one nozzle 13 of row 62 along a print line oriented substantially parallel to axis 29. As such, the embodiment of FIG. 2 provides nozzle redundancy since fluid (or ink) can be ejected through multiple nozzles along a given print line. Thus, a defective or inoperative nozzle can be compensated for by another aligned nozzle. In addition, nozzle redundancy provides the ability to alternate nozzle activation amongst aligned nozzles.

Figure 3:
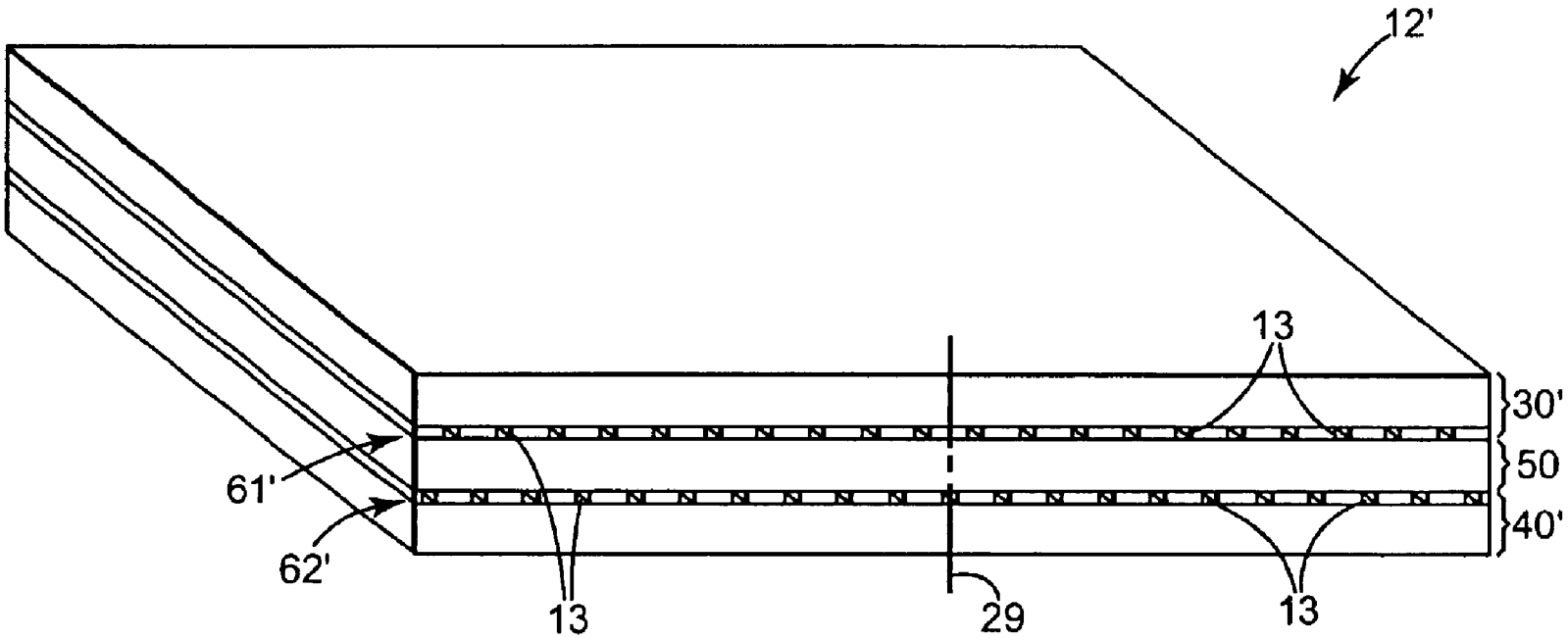
FIG. 3 is a schematic perspective view illustrating another embodiment of the printhead assembly of FIG. 2.

FIG. 3 illustrates another embodiment of a portion of printhead assembly 12. Similar to printhead assembly 12, printhead assembly 12' is a multi-layered assembly and includes outer layers 30' and 40', and inner layer 50. In addition, similar to outer layers 30 and 40, outer layers 30' and 40' are positioned on opposite sides of inner layer 50. As such, inner layer 50 and outer layers 30' and 40' form two rows 61' and 62' of nozzles 13.

As illustrated in the embodiment of FIG. 3, nozzles 13 of rows 61' and 62' are offset. More specifically, each nozzle 13 of row 61' is staggered or offset from one nozzle 13 of row 62' along a print line oriented substantially parallel to axis 29. As such, the embodiment of FIG. 3 provides increased resolution since the number of dots per inch (dpi) that can be printed along a line oriented substantially perpendicular to axis 29 is increased.

Figure 4:
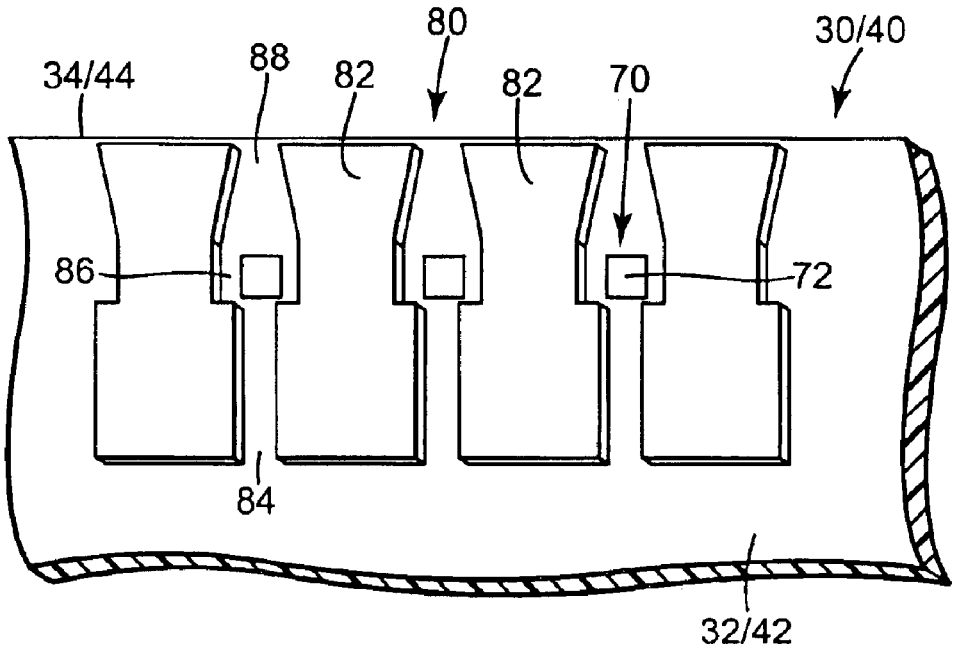
FIG. 4 is a schematic perspective view illustrating one embodiment of a portion of an outer layer of the printhead assembly of FIG. 2.

In one embodiment, as illustrated in FIG. 4, outer layers 30 and 40 (only one of which is illustrated in FIG. 4 and including outer layers 30' and 40') each include drop ejecting elements 70 and fluid pathways 80 formed on sides 32 and 42, respectively. Drop ejecting elements 70 and fluid pathways 80 are arranged such that fluid pathways 80 communicate with and supply fluid (or ink) to drop ejecting elements 70. In one embodiment, drop ejecting elements 70 and fluid pathways 80 are arranged in substantially linear arrays on sides 32 and 42 of respective outer layers 30 and 40. As such, all drop ejecting elements 70 and fluid pathways 80 of outer layer 30 are formed on a single or monolithic layer, and all drop ejecting elements 70 and fluid pathways 80 of outer layer 40 are formed on a single or monolithic layer.

In one embodiment, as described below, inner layer 50 (FIG. 2) has a fluid manifold or fluid passage defined therein which distributes fluid supplied, for example, by ink supply assembly 14 to fluid pathways 80 and drop ejecting elements 70 formed on outer layers 30 and 40.

In one embodiment, fluid pathways 80 are defined by barriers 82 formed on sides 32 and 42 of respective outer layers 30 and 40. As such, inner layer 50 (FIG. 2) and fluid pathways 80 of outer layer 30 form row 61 of nozzles 13 along edge 34, and inner layer 50 (FIG. 2) and fluid pathways 80 of outer layer 40 form row 62 of nozzles 13 along edge 44 when outer layers 30 and 40 are positioned on opposite sides of inner layer 50.

As illustrated in the embodiment of FIG. 4, each fluid pathway 80 includes a fluid inlet 84, a fluid chamber 86, and a fluid outlet 88 such that fluid chamber 86 communicates with fluid inlet 84 and fluid outlet 88. Fluid inlet 84 communicates with a supply of fluid (or ink), as described below, and supplies fluid (or ink) to fluid chamber 86. Fluid outlet 88 communicates with fluid chamber 86 and, in one embodiment, forms a portion of a respective nozzle 13 when outer layers 30 and 40 are positioned on opposite sides of inner layer 50.

In one embodiment, each drop ejecting element 70 includes a firing resistor 72 formed within fluid chamber 86 of a respective fluid pathway 80. Firing resistor 72 includes, for example, a heater resistor which, when energized, heats fluid within fluid chamber 86 to produce a bubble within fluid chamber 86 and generate a droplet of fluid which is ejected through nozzle 13. As such, in one embodiment, a respective fluid chamber 86, firing resistor 72, and nozzle 13 form a drop generator of a respective drop ejecting element 70.

In one embodiment, during operation, fluid flows from fluid inlet 84 to fluid chamber 86 where droplets of fluid are ejected from fluid chamber 86 through fluid outlet 88 and a respective nozzle 13 upon activation of a respective firing resistor 72. As such, droplets of fluid are ejected substantially parallel to sides 32 and 42 of respective outer layers 30 and 40 toward a medium. Accordingly, in one embodiment, printhead assembly 12 constitutes an edge or "side-shooter" design.

Figure 5:
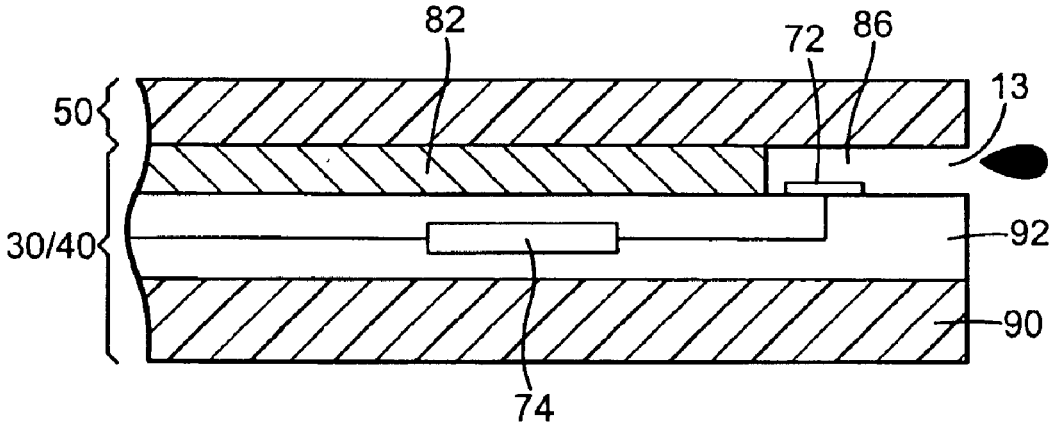
FIG. 5 is a schematic cross-sectional view illustrating one embodiment of a portion of the printhead assembly of FIG. 2.

In one embodiment, as illustrated in FIG. 5, outer layers 30 and 40 (only one of which is illustrated in FIG. 5 and including outer layers 30' and 40') each include a substrate 90 and a thin-film structure 92 formed on substrate 90. As such, firing resistors 72 of drop ejecting elements 70 and barriers 82 of fluid pathways 80 are formed on thin-film structure 92. As described above, outer layers 30 and 40 are positioned on opposite sides of inner layer 50 to form fluid chamber 86 and nozzle 13 of a respective drop ejecting element 70.

In one embodiment, inner layer 50 and substrate 90 of outer layers 30 and 40 each include a common material. As such, a coefficient of thermal expansion of inner layer 50 and outer layers 30 and 40 is substantially matched. Thus, thermal gradients between inner layer 50 and outer layers 30 and 40 are minimized. Example materials suitable for inner layer 50 and substrate 90 of outer layers 30 and 40 include glass, metal, a ceramic material, a carbon composite material, a metal matrix composite material, or any other chemically inert and thermally stable material.

In one exemplary embodiment, inner layer 50 and substrate 90 of outer layers 30 and 40 include glass such as Corning® 1737 glass or Corning® 1740 glass. In one exemplary embodiment, when inner layer 50 and substrate 90 of outer layers 30 and 40 include a metal or metal matrix composite material, an oxide layer is formed on the metal or metal matrix composite material of substrate 90.

In one embodiment, thin-film structure 92 includes drive circuitry 74 for drop ejecting elements 70. Drive circuitry 74 provides, for example, power, ground, and logic for drop ejecting elements 70 including, more specifically, firing resistors 72.

In one embodiment, thin-film structure 92 includes one or more passivation or insulation layers formed, for example, of silicon dioxide, silicon carbide, silicon nitride, tantalum, poly-silicon glass, or other suitable material. In addition, thin-film structure 92 also includes one or more conductive layers formed, for example, by aluminum, gold, tantalum, tantalum-aluminum, or other metal or metal alloy. In one embodiment, thin-film structure 92 includes thin-film transistors which form a portion of drive circuitry 74 for drop ejecting elements 70.

As illustrated in the embodiment of FIG. 5, barriers 82 of fluid pathways 80 are formed on thin-film structure 92. In one embodiment, barriers 82 are formed of a non-conductive material compatible with the fluid (or ink) to be routed through and ejected from printhead assembly 12. Example materials suitable for barriers 82 include a photo-imageable polymer and glass. The photo-imageable polymer may include a spun-on material, such as SU8, or a dry-film material, such as DuPont Vacrel®.

As illustrated in the embodiment of FIG. 5, outer layers 30 and 40 (including outer layers 30' and 40') are joined to inner layer 50 at barriers 82. In one embodiment, when barriers 82 are formed of a photo-imageable polymer or glass, outer layers 30 and 40 are bonded to inner layer 50 by temperature and pressure. Other suitable joining or bonding techniques, however, can also be used to join outer layers 30 and 40 to inner layer 50.

Figure 6:
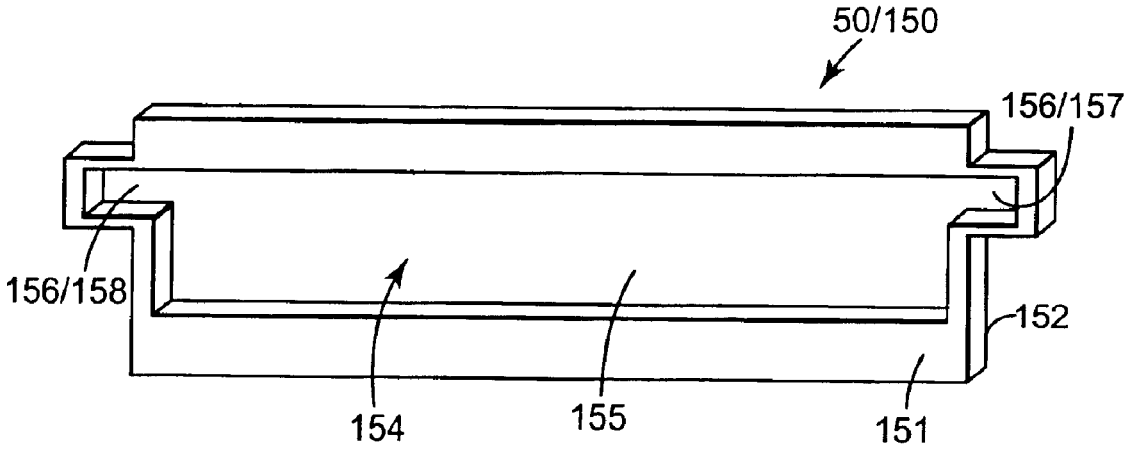
FIG. 6 is a schematic plan view illustrating one embodiment of an inner layer of the printhead assembly of FIG. 2.

In one embodiment, as illustrated in FIG. 6, inner layer 50 includes a single inner layer 150. Single inner layer 150 has a first side 151 and a second side 152 opposite first side 151. In one embodiment, side 32 of outer layer 30 is adjacent first side 151 and side 42 of outer layer 40 is adjacent second side 152 when outer layers 30 and 40 are positioned on opposite sides of inner layer 50.

In one embodiment, single inner layer 150 has a fluid passage 154 defined therein. Fluid passage 154 includes, for example, an opening 155 which communicates with first side 151 and second side 152 of single inner layer 150 and extends between opposite ends of single inner layer 150. As such, fluid passage 154 distributes fluid through single inner layer 150 and to fluid pathways 80 of outer layers 30 and 40 when outer layers 30 and 40 are positioned on opposite sides of single inner layer 150.

As illustrated in the embodiment of FIG. 6, single inner layer 150 includes at least one fluid port 156. In one exemplary embodiment, single inner layer 150 includes fluid ports 157 and 158 each communicating with fluid passage 154. In one embodiment, fluid ports 157 and 158 form a fluid inlet and a fluid outlet for fluid passage 154. As such, fluid ports 157 and 158 communicate with ink supply assembly 14 and enable circulation of fluid (or ink) between ink supply assembly 14 and printhead assembly 12.

Figure 7:
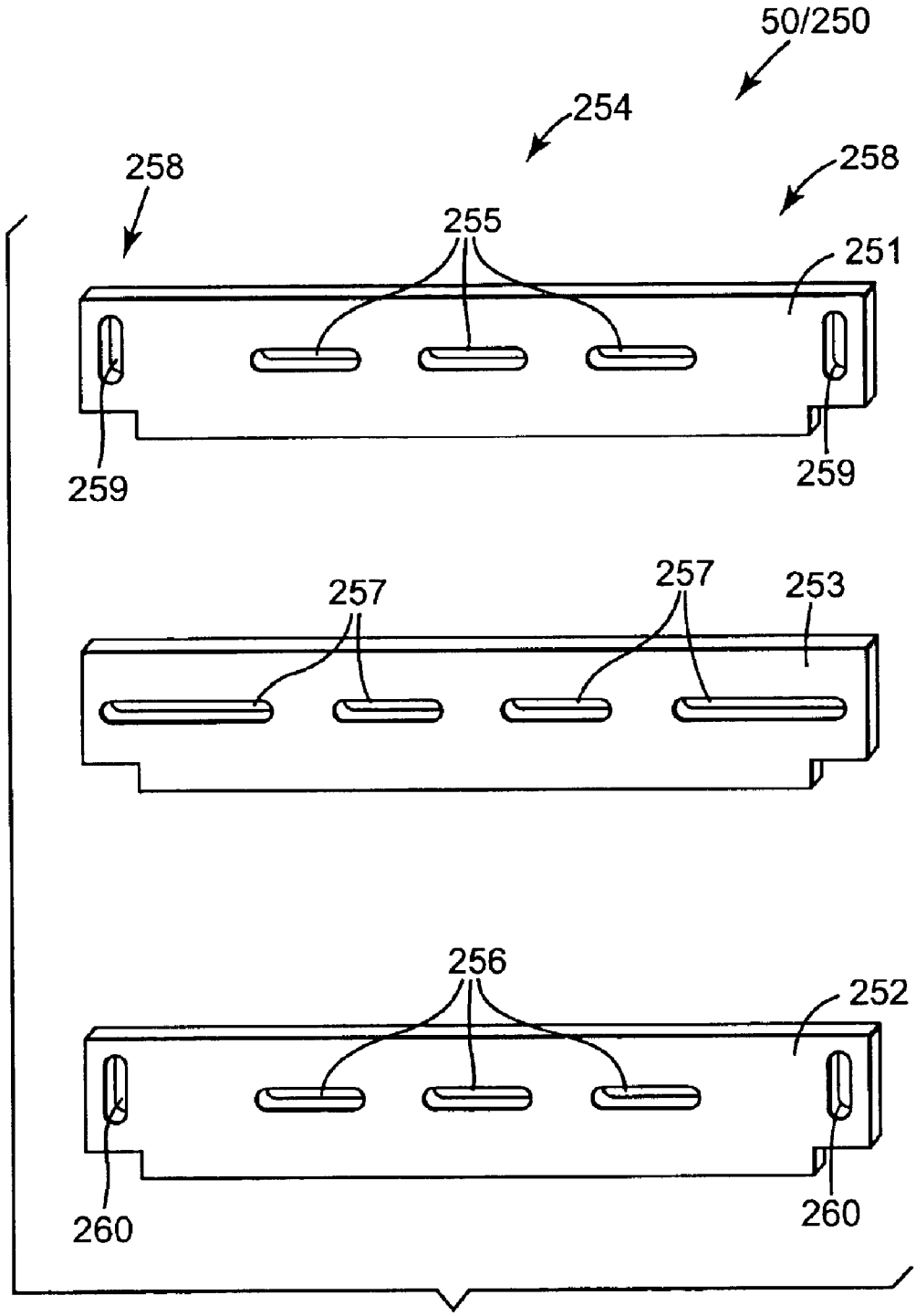
FIG. 7 is a schematic plan view illustrating another embodiment of an inner layer of the printhead assembly of FIG. 2.

In another embodiment, as illustrated in FIG. 7, inner layer 50 includes a plurality of inner layers 250. In one exemplary embodiment, inner layers 250 include inner layers 251, 252, and 253 such that inner layer 253 is interposed between inner layers 251 and 252. As such, side 32 of outer layer 30 is adjacent inner layer 251 and side 42 of outer layer 40 is adjacent inner layer 252 when outer layers 30 and 40 are positioned on opposite sides of inner layers 250.

In one exemplary embodiment, inner layers 251, 252, and 253 are joined together by glass frit bonding. As such, glass frit material is deposited and patterned on inner layers 251, 252, and/or 253, and inner layers 251, 252, and 253 are bonded together under temperature and pressure. Thus, joints between inner layers 251, 252, and 253 are thermally matched. In another exemplary embodiment, inner layers 251, 252, and 253 are joined together by anodic bonding. As such, inner layers 251, 252, and 253 are brought into intimate contact and a voltage is applied across the layers. Thus, joints between inner layers 251, 252, and 253 are thermally matched and chemically inert since no additional material is used. In another exemplary embodiment, inner layers 251, 252, and 253 are joined together by adhesive bonding. Other suitable joining or bonding techniques, however, can also be used to join inner layers 251, 252, and 253.

In one embodiment, inner layers 250 have a fluid manifold or fluid passage 254 defined therein. Fluid passage 254 includes, for example, openings 255 formed in inner layer 251, openings 256 formed in inner layer 252, and openings 257 formed in inner layer 253. Openings 255, 256, and 257 are formed and arranged such that openings 257 of inner layer 253 communicate with openings 255 and 256 of inner layers 251 and 252, respectively, when inner layer 253 is interposed between inner layers 251 and 252. As such, fluid passage 254 distributes fluid through inner layers 250 and to fluid pathways 80 of outer layers 30 and 40 when outer layers 30 and 40 are positioned on opposite sides of inner layers 250.

As illustrated in the embodiment of FIG. 7, inner layers 250 include at least one fluid port 258. In one exemplary embodiment, inner layers 250 include fluid ports 259 and 260 each formed in inner layers 251 and 252. As such, fluid ports 259 and 260 communicate with openings 257 of inner layer 253 when inner layer 253 is interposed between inner layers 251 and 252. In one embodiment, fluid ports 259 and 260 form a fluid inlet and a fluid outlet for fluid passage 254. As such, fluid ports 259 and 260 communicate with ink supply assembly 14 and enable circulation of fluid (or ink) between ink supply assembly 14 and printhead assembly 12.

In one embodiment, by forming drop ejecting elements 70 and fluid pathways 80 on outer layers 30 and 40, and positioning outer layers 30 and 40 on opposite sides of inner layer 50, as described above, printhead assembly 12 can be formed of varying lengths. For example, printhead assembly 12 may span a nominal page width, or a width shorter or longer than nominal page width. In one exemplary embodiment, printhead assembly 12 is formed as a wide-array or page-wide array such that rows 61 and 62 of nozzles 13 span a nominal page width.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection assembly, comprising:

at least one inner layer having a fluid passage defined therein; and first and second outer layers positioned on opposite sides of the at least one inner layer, the first and second outer layers each having a side adjacent the at least one inner layer and including drop ejecting elements formed on the side and fluid pathways communicated with the drop ejecting elements, wherein the fluid pathways of the first and second outer layers communicate with the fluid passage of the at least one inner layer, and wherein the at least one inner layer and the fluid pathways of the first outer layer form a first row of nozzles, and the at least one inner layer and the fluid pathways of the second outer layer form a second row of nozzles.

2. The fluid ejection assembly of claim 1, wherein the at least one inner layer includes a single inner layer having a first side and a second side opposite the first side, wherein the first outer layer is adjacent the first side and the second outer layer is adjacent the second side.

3. The fluid ejection assembly of claim 2, wherein the fluid passage of the at least one inner layer includes an opening communicated with the first side and the second side of the single inner layer and extended between opposite ends of the single inner layer.

4. The fluid ejection assembly of claim 1, wherein the at least one inner layer includes a first inner layer adjacent the first outer layer, a second inner layer adjacent the second outer layer, and a third inner layer interposed between the first inner layer and the second inner layer.

5. The fluid ejection assembly of claim 4, wherein the fluid passage of the at least one inner layer includes a first plurality of openings formed in the first inner layer, a second plurality of openings formed in the second inner layer, and a third plurality of openings formed in the third inner layer, wherein the third plurality of openings communicate with the first plurality of openings and the second plurality of openings when the third inner layer is interposed between the first inner layer and the second inner layer.

6. The fluid ejection assembly of claim 1, wherein the drop ejecting elements of the first outer layer are adapted to eject drops of fluid through the first row of nozzles substantially parallel to the side of the first outer layer, and wherein the drop ejecting elements of the second outer layer are adapted to eject drops of fluid through the second row of nozzles substantially parallel to the side of the second outer layer.

7. The fluid ejection assembly of claim 1, wherein the first and second outer layers each have an edge contiguous with the side thereof, wherein the first row of nozzles extend along the edge of the first outer layer and the second row of nozzles extend along the edge of the second outer layer.

8. The fluid ejection assembly of claim 1, wherein the at least one inner layer and the first and second outer layers each include a common material, wherein the common material includes one of glass, a ceramic material, a carbon composite material, metal, and a metal matrix composite material.

9. The fluid ejection assembly of claim 1, wherein each of the fluid pathways of the first and second outer layers include a fluid inlet, a fluid chamber communicated with the fluid inlet, and a fluid outlet communicated with the fluid chamber, and wherein each of the drop ejecting elements of the first and second outer layers include a firing resistor formed within the fluid chamber of one of the fluid pathways.

10. The fluid ejection assembly of claim 9, wherein the first and second outer layers each include a substrate and a thin-film structure formed on the substrate, wherein the firing resistor of each of the drop ejecting elements is formed on the thin-film structure of the first and second outer layers.

11. The fluid ejection assembly of claim 10, wherein the substrate of each of the first and second outer layers includes a non-conductive material.

12. The fluid ejection assembly of claim 11, wherein the non-conductive material includes one of glass, a ceramic material, a carbon composite material, and an oxide formed on one of a metal and a metal matrix composite material.

13. The fluid ejection assembly of claim 10, wherein the thin-film structure includes drive circuitry of the drop ejecting elements.

14. The fluid ejection assembly of claim 13, wherein the drive circuitry includes thin-film transistors.

15. The fluid ejection assembly of claim 10, wherein the first and second outer layers each include barriers formed between the fluid pathways, wherein the barriers are formed on the thin-film structure of the first and second outer layers.

16. The fluid ejection assembly of claim 15, wherein the barriers are formed of one of a photo-imageable polymer and glass.

17. The fluid ejection assembly of claim 1, wherein the at least one inner layer further includes at least one fluid port communicated with the fluid passage.

18. The fluid ejection assembly of claim 1, wherein the first row of nozzles and the second row of nozzles span a distance less than approximately two inches.

19. The fluid ejection assembly of claim 1, wherein the first row of nozzles and the second row of nozzles span a distance greater than approximately two inches.

20. The fluid ejection assembly of claim 1, wherein each nozzle of the first row of nozzles is substantially aligned with one nozzle of the second row of nozzles.

21. The fluid ejection assembly of claim 1, wherein each nozzle of the first row of nozzles is offset from one nozzle of the second row of nozzles.

22. A method of forming a fluid ejection assembly, the method comprising:

defining a fluid passage in at least one inner layer;

forming drop ejecting elements on a side of each of first and second outer layers;

forming fluid pathways on the side of each of the first and second outer layers, including communicating the fluid pathways with the drop ejecting elements; and positioning the first and second outer layers on opposite sides of the at least one inner layer, including communicating the fluid pathways of the first and second outer layers with the fluid passage of the at least one inner layer, and forming a first row of nozzles with the at least one inner layer and the fluid pathways of the first outer layer and forming a second row of nozzles with the at least one inner layer and the fluid pathways of the second outer layer.

23. The method of claim 22, wherein defining the fluid passage includes defining the fluid passage in a single inner layer having a first side and a second side opposite the first side, wherein positioning the first and second outer layers includes positioning the first outer layer adjacent the first side and positioning the second outer layer adjacent the second side.

24. The method of claim 23, wherein defining the fluid passage in the single inner layer includes communicating an opening with the first side and the second side of the single inner layer and extending the opening between opposite ends of the single inner layer.

25. The method of claim 22, wherein defining the fluid passage includes defining the fluid passage in a first inner layer, a second inner layer, and a third inner layer interposed between the first inner layer and the second inner layer, wherein positioning the first and second outer layers includes positioning the first outer layer adjacent the first inner layer and positioning the second outer layer adjacent the second inner layer.

26. The method of claim 25, wherein defining the fluid passage in the first inner layer, the second inner layer, and the third inner layer includes forming a first plurality of openings in the first inner layer, forming a second plurality of openings in the second inner layer, and forming a third plurality of openings in the third inner layer, wherein the third plurality of openings communicate with the first plurality of openings and the second plurality of openings when the third inner layer is interposed between the first inner layer and the second inner layer.

27. The method of claim 22, wherein the drop ejecting elements of the first outer layer are adapted to eject drops of fluid through the first row of nozzles substantially parallel to the side of the first outer layer, and wherein the drop ejecting elements of the second outer layer are adapted to eject drops of fluid through the second row of nozzles substantially parallel to the side of the second outer layer.

28. The method of claim 22, wherein forming the first row of nozzles includes forming the first row of nozzles along an edge of the first outer layer adjacent the side thereof, and forming the second row of nozzles includes forming the second row of nozzles along an edge of the second outer layer adjacent the side thereof.

29. The method of claim 22, wherein the at least one inner layer and the first and second outer layers each include a common material, wherein the common material includes one of glass, a ceramic material, a carbon composite material, metal, and a metal matrix composite material.

30. The method of claim 22, wherein forming each of the fluid pathways includes forming a fluid inlet, communicating a fluid chamber with the fluid inlet, and communicating a fluid outlet with the fluid chamber, and wherein forming each of the drop ejecting elements includes forming a firing resistor within the fluid chamber of one of the fluid pathways.

31. The method of claim 30, further comprising:

forming the first and second outer layers, including forming a thin-film structure on a substrate of each of the first and second outer layers, wherein forming the drop ejecting elements includes forming the firing resistor of each of the drop ejecting elements on the thin-film structure of the first and second outer layers.

32. The method of claim 31, wherein the substrate of each of the first and second outer layers includes a non-conductive material.

33. The method of claim 32, wherein the non-conductive material includes one of glass, a ceramic material, a carbon composite material, and an oxide formed on one of a metal and a metal matrix composite material.

34. The method of claim 31, wherein forming the thin-film structure includes forming drive circuitry of the drop ejecting elements.

35. The method of claim 34, wherein forming the drive circuitry of the drop ejecting elements includes forming thin-film transistors.

36. The method of claim 31, wherein forming the fluid pathways includes forming barriers on the thin-film structure of the first and second outer layers between the fluid pathways.

37. The method of claim 36, wherein the barriers are formed of one of a photo-imageable polymer and glass.

38. The method of claim 22, further comprising:

defining at least one fluid port in the at least one inner layer, including communicating the at least one fluid port with the fluid passage.

39. The method of claim 22, wherein forming the first row of nozzles and forming the second row of nozzles includes extending the first row of nozzles and the second row of nozzles a distance less than approximately two inches.

40. The method of claim 22, wherein forming the first row of nozzles and forming the second row of nozzles includes extending the first row of nozzles and the second row of nozzles a distance greater than approximately two inches.

41. The method of claim 22, wherein forming the first row of nozzles and forming the second row of nozzles includes substantially aligning each nozzle of the first row of nozzles with one nozzle of the second row of nozzles.

42. The method of claim 22, wherein forming the first row of nozzles and forming the second row of nozzles includes offsetting each nozzle of the first row of nozzles from one nozzle of the second row of nozzles.

43. A fluid ejection assembly, comprising:

first and second layers spaced from and facing each other;

fluid pathways formed on the first and second layers;

drop ejecting elements each communicated with one of the fluid pathways;

means interposed between the first and second layers for routing fluid to the fluid pathways; and means for forming nozzles for the drop ejecting elements.

44. The fluid ejection assembly of claim 43, wherein means for routing fluid to the fluid pathways includes at least one layer interposed between the first and second layers and having a fluid passage defined therein.

45. The fluid ejection assembly of claim 44, wherein the at least one layer and the first and second layers each include a common material, wherein the common material includes one of glass, a ceramic material, a carbon composite material, metal, and a metal matrix composite material.

46. The fluid ejection assembly of claim 43, wherein means for forming nozzles for the drop ejecting elements includes at least one layer interposed between the first and second layers, wherein the at least one layer and the fluid pathways on the first layer form a first plurality of the nozzles, and the at least one layer and the fluid pathways on the second layer form a second plurality of the nozzles.

47. The fluid ejection assembly of claim 43, wherein the drop ejecting elements are formed on a side of each of the first and second layers, and wherein the drop ejecting elements are adapted to eject drops of fluid through the nozzles substantially parallel to the side of each of the first and second layers.

48. The fluid ejection assembly of claim 43, wherein the first and second layers each include a substrate and a thin-film structure formed on the substrate, wherein the drop ejecting elements are formed on the thin-film structure of the first and second layers.

49. The fluid ejection assembly of claim 48, wherein the thin-film structure includes drive circuitry of the drop ejecting elements, wherein the drive circuitry includes thin-film transistors.

50. The fluid ejection assembly of claim 48, further comprising:

barriers formed on the thin-film structure of the first and second layers between the fluid pathways.

51. A method of operating a fluid ejection assembly, the method comprising:

routing fluid to fluid pathways formed on first and second outer layers positioned on opposite sides of at least one inner layer, including distributing the fluid to the fluid pathways through a fluid passage defined in the at least one inner layer; and ejecting drops of the fluid from drop ejecting elements formed on the first and second outer layers and each communicated with one of the fluid pathways, including ejecting drops of the fluid through a first row of nozzles formed with the at least one inner layer and the fluid pathways of the first outer layer and ejecting drops of the fluid through a second row of nozzles formed with the at least one inner layer and the fluid pathways of the second outer layer.

52. The method of claim 51, wherein routing fluid to the fluid pathways includes routing fluid to a fluid chamber of each of the fluid pathways, and wherein ejecting drops of the fluid includes ejecting the drops with firing resistors each formed within the fluid chamber of one of the fluid pathways.

53. The method of claim 51, wherein ejecting drops of the fluid includes ejecting drops through the first row of nozzles and the second row of nozzles substantially parallel to a side of each of the first and second outer layers on which the drop ejecting elements are formed.

54. The method of claim 51, wherein ejecting drops of the fluid includes operating the drop ejecting elements with drive circuitry formed in a thin-film structure of each of the first and second outer layers.

55. The method of claim 54, wherein routing fluid to the fluid pathways includes routing fluid between barriers formed on the thin-film structure of each of the first and second outer layers.

* * * * *